United States Patent [19]

Geiger

[11] Patent Number: 4,865,087

[45] Date of Patent: Sep. 12, 1989

[54] WIRE TYING MECHANISM

[75] Inventor: Robert E. Geiger, Sayre, Pa.

[73] Assignee: Ingersoll-Rand Company, Woodcliff Lake, N.J.

[21] Appl. No.: 189,564

[22] Filed: May 3, 1988

[51] Int. Cl.[4] ..... B21F 9/02

[52] U.S. Cl. ..... 140/119; 140/57

[58] Field of Search ..... 140/57, 93 A, 93.6, 140/119; 100/8, 10, 31

[56] References Cited

U.S. PATENT DOCUMENTS 1,151,752 8/1915 Bates ..... 140/93 A 3,163,187 12/1964 MacIntosh ..... 140/93.6

4,705,080 11/1987 Hanscom ..... 140/93 A

*Primary Examiner*—Lowell A. Larson

*Attorney, Agent, or Firm*—Walter C. Vliet; Arthur N. Trausch

[57] ABSTRACT

Disclosed is a wire tying mechanism which includes a mechanism for bending a wire partially around an object, a mechanism for holding the end portions of the wire by frictional clamping, and a mechanism for axially pulling the wire tight against the object and rotating the hold mechanism so as to twist the ends of the wire about each other.

4 Claims, 5 Drawing Sheets

WIRE TYING MECHANISM

FIELD OF THE INVENTION

This invention relates to a mechanism for binding objects with wire. More specifically, this invention relates to a mechanism for tightening and twisting together the two end portions of a wire around articles such as bars or rods.

BACKGROUND OF THE INVENTION

Concrete reinforcing rods are usually bound together with wire prior to pouring cement. Currently, the wire is often cut and installed on the bars by hand. The automatic tools that are available either produce a loose tie or are unreliable in construction environments because of the complex mechanisms required to twist and tie wire.

U.S. Pat. No. 3,323,558 to Collins for example discloses a wire tying apparatus that uses a twist pin to twist the wire. The Collins tool does not have any mechanism for holding the ends of the wires when they are being twisted. The ends of the wire are free in the cross opening of the twist pin.

U.S. Pat. No. 4,117,872 to Gott et al for example discloses a wire twisting device that uses a variable position jaw mechanism and a rotatable twisting head. Both mechanisms involve precise mechanical movements and parts.

SUMMARY OF THE INVENTION

Thus it is a primary object of this invention to provide a simple, reliable and durable mechanism for tightly binding wire around an object.

Another object of this invention is to provide a mechanism whose operations are simple and inherently timed and are not susceptible to malfunction from contamination.

Another object of this invention is to provide a mechanism having a simple and reliable friction clamping mechanism for producing a tight wire twist.

DETAILED DESCRIPTION OF THE INVENTION

Figure 1:
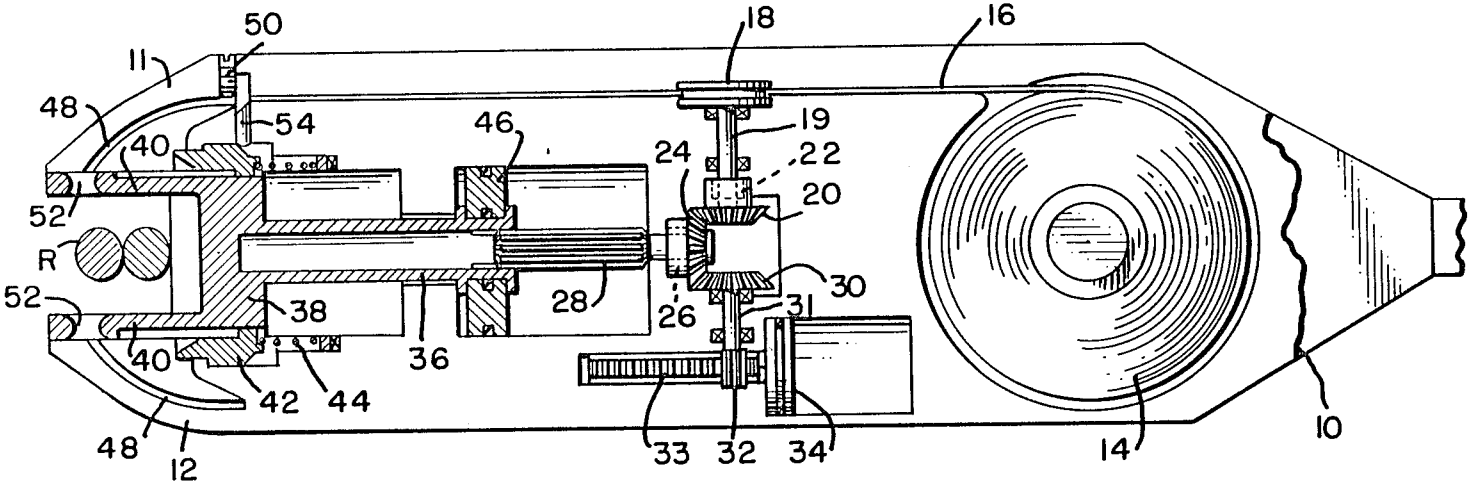
FIG. 1 schematically depicts the basic mechanism of the present invention in the ready position.

Referring now to the drawings, wherein like reference numbers designate identical or corresponding parts throughout the several views, and more particularly to FIG. 1, a preferred embodiment of the invention will now be described. The preferred embodiment will be described in the context of an air operated tool for tying reinforcing bars together. However, as will be pointed out, electric motors and sensors could be substituted for the air operated pistons and valves. Also the object that is tied with wire could be a single article or a plurality of articles such as bars or rods.

The tool has a housing 10 which includes stationary feed jaws 11 and 12 at the forward end. The rear end of the housing contains a spool of wire 14 which is fed through a groove 16 in the housing. A wire feed wheel 18 provides the drive to feed the wire forward to the feed jaws. A spring loaded idler wheel may also be provided to adjustably change the pressure on the wire for proper feeding.

The feed wheel 18 is mounted on a shaft 19 which is connected to a bevel gear 20 containing a one-way clutch 22. Bevel gear 20 is driven by another bevel gear 24 which also contains a one-way clutch 26 connected to a splined shaft 28. Bevel gear 24 is driven by bevel gear 30 which is connected to a shaft 31 having a spur gear 32 mounted on the end. The spur gear is engaged with a spur gear rack 33 connected to a first linear actuator 34 such as a pneumatic piston (shown) or a solenoid actuator.

The splined shaft 28 is connected into the projecting tubular stem 36 of the rotatable and axially moveable tensioning and twisting head 38. The stem 36 can slide axially on shaft 28 but is keyed to rotate with shaft 28 when it is rotated by the bevel gear 24.

The jaw mechanism includes the fixed feed jaws 11 and 12 and the rotatable and axially moveable tensioning and twisting head 38. Two arms 40 extend axially forward from the head 38 to straddle the space in which the articles to be bound with wire are located. A tension sleeve 42 is rotatively keyed to the outside of the head 38. The sleeve is axially biased forward by a compression spring 44 acting against the housing. The housing 10 limits the axial movement of the sleeve 42 relative to the head 38. Connected to the stem 36 of the head 38 is a second linear actuator 46. Again a pneumatic piston is shown but a solenoid actuator could also be used. Because the piston 46 is fixed to stem 36, the piston causes the mechanism 46 and the stem 36 and head 38 to slide axially on shaft 28.

The feed jaws 11 and 12 includes two wire guides 48 which form a split semi-circle extension of the groove 16. An adjustable forming mandrel 50 is positioned at the beginning of one wire guide so that the wire from the groove 16 is curled and advances through the first wire guide, across the open semi-circle and into the other wire guide.

The extended arms 40 of the head 38 straddle the open-ended space between the two wire guides 48. Objects such as rods or re-bars R can quickly and easily be straddled by the jaw mechanism. The present invention does not have complex parts which pivot to an open or closed position, as in some prior art devices. The arms 40 have openings 52 near each end such that an unobstructed wire path is provided between the wire guides 48 so that the semi-loop of wire can contain the articles R.

The housing also includes a wire cut-off mechanism 54 between the wire groove 16 and the first wire guide 48. The cut-off mechanism can be cam actuated by the axial movement of the sleeve 42.

To operate the tool, the operator positions the re-bar or other objects to be bound together in the open-ended area between the arms 40 and actuates a throttle. If the tool is pneumatic, the throttle controls the flow of high pressure inlet air to the piston actuators. If the tool is electric, the throttle controls the flow of electric current to the motors. In the following description of the operation, the actuating mechanisms are pneumatic although electromagnetic solenoid actuators could also be used.

Figure 2:
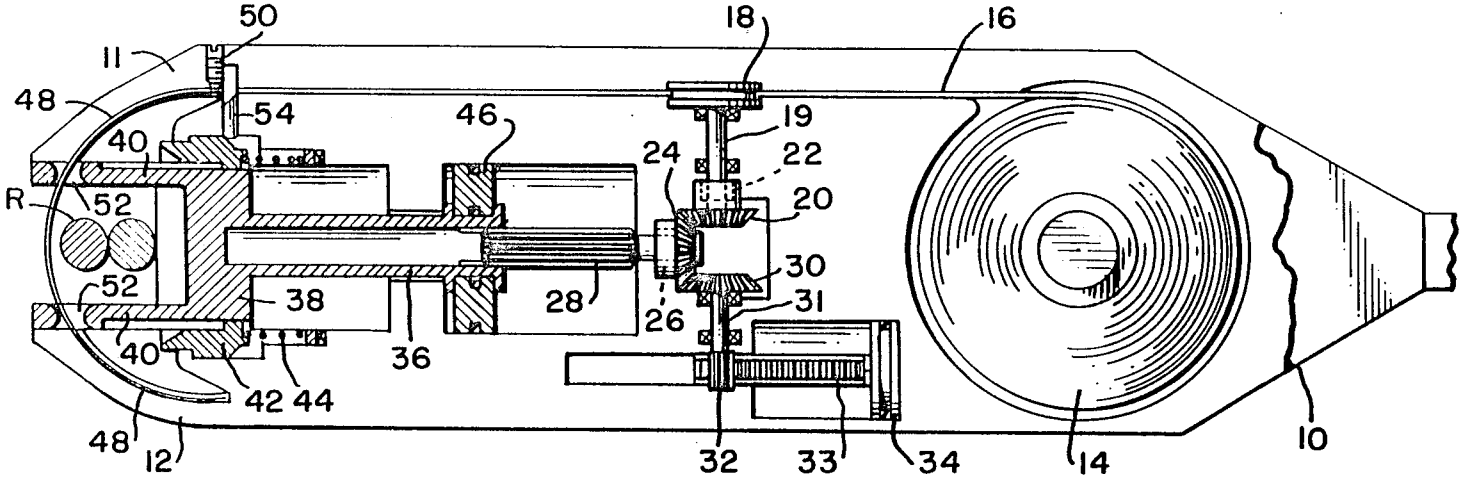
FIGS. 2–5 depict the mechanism during various steps in a cycle of operation.

Referring to FIG. 2, the high pressure air from the throttle first flows to the left side of the piston 34, pushing it to the right and pulling the rack 33 along to the right. This causes spur gear 32 and bevel gear 30 to rotate clockwise as viewed from the bevel gear end.

Bevel gear 30 turns bevel gear 24 counterclockwise and the one-way clutch 26 slips on shaft 28.

Bevel gear 20 is driven clockwise. The one-way clutch 22 in bevel gear 20 drives in the clockwise direction. Therefore, the wire feed wheel 18 rotates, feeding the proper length of wire through the jaw mechanism. The length of wire fed is determined by the wheel diameter, the gear ratios and the piston travel.

As the wire is being fed through the groove 16, an adjustable mandrel 50 pushes against the wire causing it to curl at the desired radius. This is to ensure that it follows the guide 48 in feed jaw 11, through the openings 52 in the arms 40 of the rotatable head 38 and into the guide 48 of feed jaw 12.

When the wire reaches the bottom of the guide 48 in feed jaw 12, or when piston 34 reaches the end of its travel, a mechanism such as an air valve (not shown) is triggered so that air flows to the left side of piston 46. At the same time air vents from the right side of piston 46 through an adjustable bleed valve (not shown) to prevent too rapid travel of piston 46.

Figure 3:
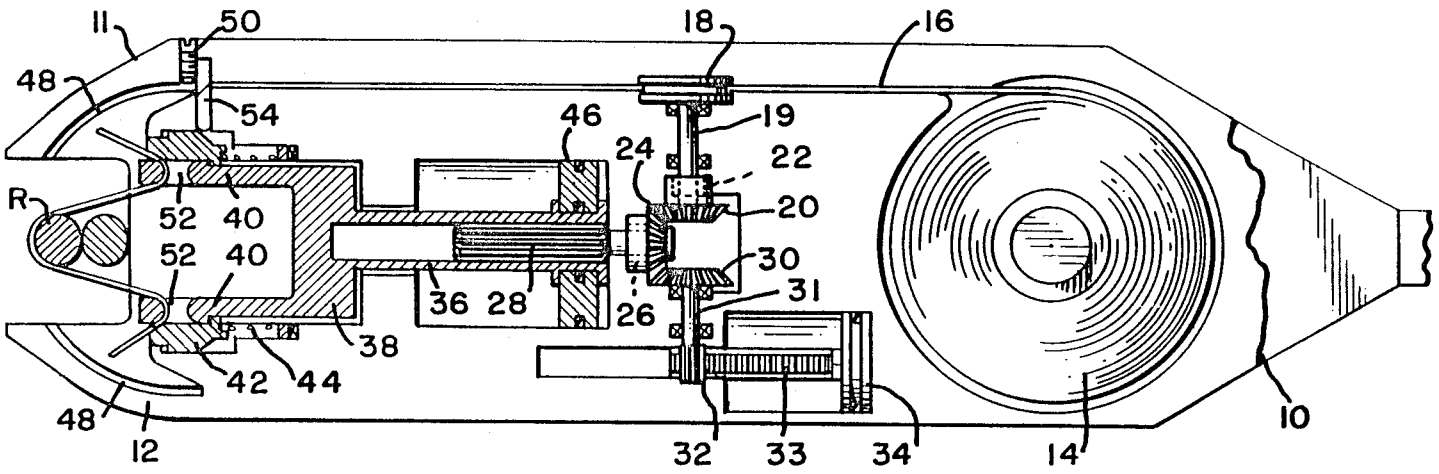

Referring now to FIG. 3, as piston 46 moves to the right it pulls stem 36 and head 38 along with it. Since the wire is contained within the openings 52 in the arms 40 of the head 38 and is also located forward of the re-bars, the wire is forced to bend around the re-bars as the wire is pulled rearward by the arms.

At approximately the same time as the head 38 begins to move rearward, the wire in the groove 16 is cut by cut-off mechanism 54. The cut-off mechanism can be cam operated by the axial movement of tensioning sleeve 42 or can be operated by a separate air valve, for example.

As the piston 46 advances, both ends of the wire are frictionally clamped between the arms 40 of the head 38 and tapered notches in the spring loaded tensioning sleeve 42. As can be seen in FIG. 3 the tensioning sleeve 42 is forced back slightly against the tensioning spring 44. Note that the rearward motion of the head 38 causes the end portions of the wire to be bent forward. These bends increase the frictional grip the arms 40 and the tensioning sleeve 42 have on the wire.

When the piston 46 reaches the end of its travel, it triggers another mechanism (not shown) which shuts off inlet air to the left side of piston 34. The left side of piston 34 is vented and the flow of inlet air is switched to the right side of the piston. Piston 46 remains pressurized to hold head 38 to the rear.

Figure 4:
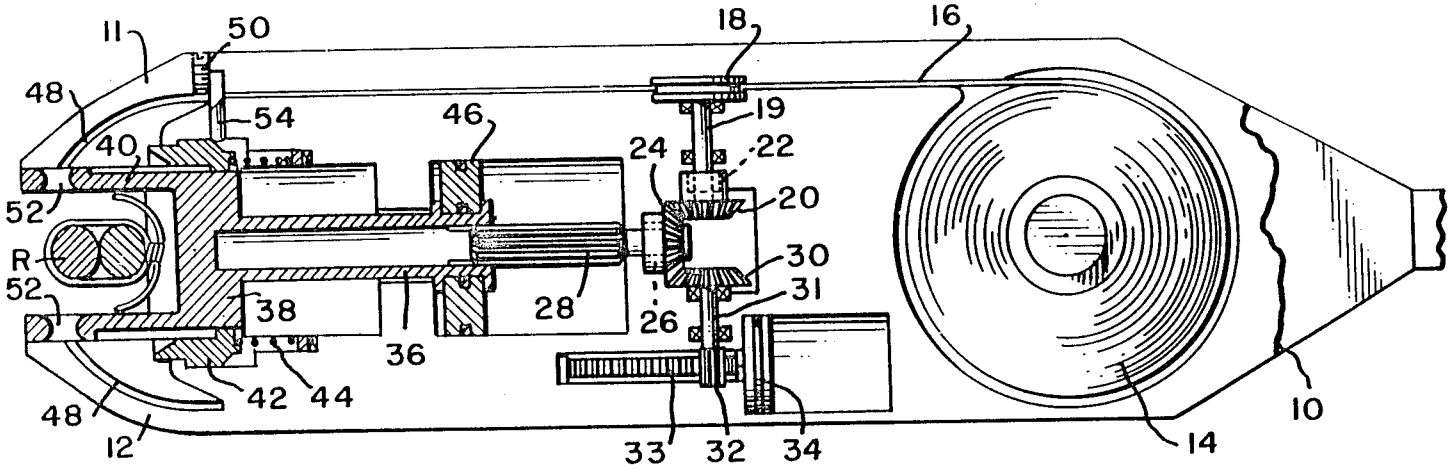

Referring to FIG. 4, the air now forces piston 34 and the rack 33 to the left, causing the spur gear 32 and bevel gear 30 to rotate counterclockwise as viewed from bevel gear end. Bevel gear 30 turns bevel gear 24 clockwise and because the one-way clutch 26 drives clockwise, shaft 28 is rotated. Meanwhile, bevel gear 20 rotates counterclockwise but the wire feed wheel 18 does not turn because the one-way clutch 22 drives in the clockwise direction.

As best seen in FIG. 4, as shaft 28 rotates, tensioning and twisting head 38 rotates because of the splined joint connection of shaft 28 and the tubular stem 36. As the arms 40 rotate, the ends of the wire are twisted around the re-bars. The twisted joint is tight because of the frictional clamping on the wire by the arms 40 and the tensioning sleeve 42 created by the tensioning spring 44. The relatively equivalent axial location of the wire in the openings 52 with respect to the re-bar enhances the tightness of the joint because the wire is forced to twist from the re-bar outward. This means the first twist will be tight because there is no slack between the re-bar and the wire. Although one tight twist is sufficient to produce a tight joint, any number of twists can be produced based on gear ratios and piston travel.

Figure 5:
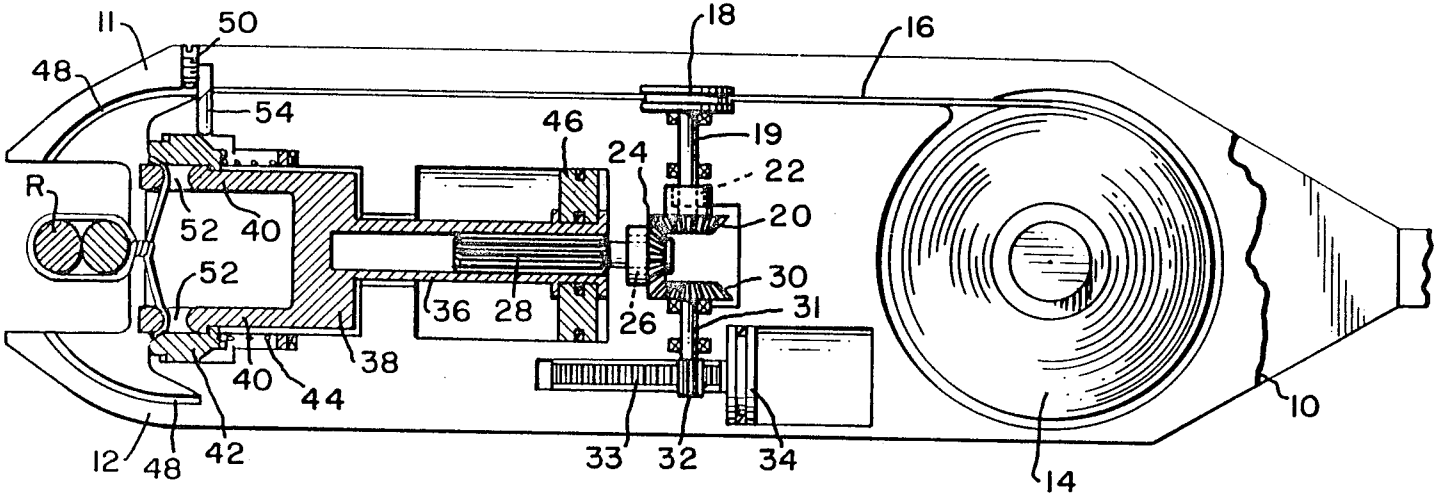

Referring to FIG. 5 when the piston 34 reaches the end of its stroke, it triggers another conventional mechanism (not shown) that allows air to flow to the right side of piston 46 and at the same time vents the left side through an adjustable valve (not shown) to prevent too rapid of travel of piston 46. As piston 46 moves to the left the head 38 also moves, releasing the ends of the wire from the openings 52 in the arms, and also pushing the ends down and around the re-bars for a neat and safe joint, with the sharp ends of the wire pointed down. When piston 46 reaches the end of its stroke, it trips a conventional mechanism (not shown) shutting off the inlet air. The unit is now reset for the next cycle.

As previously noted, this type of mechanism cannot only bind re-bar, as set forth in the preferred embodiment, but can also bind anything that would fit in the jaw straddle space such as pipes, rods, bars, wooden parts, plastic parts, etc. The size of the mechanism can also be varied to accommodate smaller or larger parts.

Numerous modifications and variations of the present invention are possible in light of the above teachings. It is therefore to be understood that the invention may be practiced other than as specifically described herein and it is intended that the invention be limited only by the language of the following claims.

I claim:

1. A mechanism for tying the ends of a wire around an object, comprising: means for bending the wire partially around the object; means for holding the end portions of the wire on opposite sides of the object by frictional clamping; means for moving the center portion of the wire into contact with the object; means for rotating the holding means so as to twist the end portions of the wire about each other; a member having two arms, each arm positioned on opposite sides of the object so as to straddle the object; an opening in each arm so as to contain the end portions of the wire which is bent partially around the object; and an axially biased sleeve positioned around the arms to hold the end portions of the wire in clamping contact with the arms.

2. The mechanism of claim 1 wherein the moving means further comprises:

a tubular stem extending from the member for axially guiding the member;

a linear actuator for axially moving the member out of alignment with the object and pulling the wire into contact with the object.

3. The mechanism of claim 2 wherein the rotating means further comprises:

a shaft in a fixed rotational relationship with the tubular stem;

an actuator for rotating the shaft; and means for limiting rotation of the shaft to only one direction.

4. The mechanism of claim 3 further comprising:

means for feeding wire through the mechanism;

means for cutting the wire; and means for releasing the holding means.

* * * * *